United States Patent [19]

Langley

[11] 4,130,055

[45] Dec. 19, 1978

[54] ASSEMBLY FOR CLEANING AND PACKING CURED TOBACCO

[76] Inventor: Marvin A. Langley, Rte. 1, Box 382, Fountain, N.C. 27829

[21] Appl. No.: 826,990

[22] Filed: Aug. 23, 1977

[51] Int. Cl.[2] ..... B30B 1/32

[52] U.S. Cl. ..... 100/91; 100/100; 100/102; 100/208; 100/215; 100/218; 100/226; 100/246; 100/295

[58] Field of Search ..... 100/102, 70, 100, 215, 100/91, 226, 295, 193, 218, 240, 246, 208, 237; 15/90; 209/86, 288

[56] References Cited

U.S. PATENT DOCUMENTS

| | | | |
|---|---|---|---|
| 188,693 | 3/1877 | Talbott | 100/226 X |
| 505,881 | 10/1893 | Kester | 100/226 |
| 731,955 | 6/1903 | Root | 100/91 X |
| 737,427 | 8/1903 | Lemberg | 100/208 |
| 1,002,975 | 9/1911 | Eagleson | 100/226 |
| 2,440,008 | 4/1948 | Gardner | 209/288 |
| 2,961,977 | 11/1960 | Coleman | 100/228 X |
| 3,882,771 | 5/1975 | Frohbieter | 100/229 A |
| 4,018,675 | 4/1977 | Petrucci | 209/86 |

FOREIGN PATENT DOCUMENTS

| | | | |
|---|---|---|---|
| 223602 | 9/1958 | Australia | 100/100 |
| 129766 | 4/1902 | Fed. Rep. of Germany | 100/208 |
| 801964 | 1/1951 | Fed. Rep. of Germany | 100/246 |

*Primary Examiner*—Billy J. Wilhite

*Attorney, Agent, or Firm*—Shlesinger, Arkwright, Garvey & Dinsmore

[57] ABSTRACT

An assembly for cleaning and packing tobacco leaves after curing. The cured tobacco leaves are conveyed to a rotating drum of wire construction to allow sand and dirt to be removed from the tobacco leaves while being tumbled. The cleaned tobacco leaves are then deposited within a sheeting ring which is positioned on a tobacco sheet. A power operated compression member engages the tobacco leaves within the ring to compress the same. Locking elements are provided for selectively engaging the sheeting ring with the compression member for removing the same as a unit from the tobacco, following which the ends of the tobacco sheet are tied together.

9 Claims, 5 Drawing Figures

ASSEMBLY FOR CLEANING AND PACKING CURED TOBACCO

BACKGROUND OF THE INVENTION

It has been standard practice over the years to cure tobacco leaves by hanging the same in barns. More recently, curing has been effected by placing the tobacco leaves in large curing containers through which rods are placed for holding the leaves in position. After curing is completed, the rods are removed and the tobacco leaves gravitate to the ground. The cured tobacco leaves are next placed on a tobacco sheet within a sheeting ring and then manually compressed. The sheeting rings are removed, the ends of the tobacco sheet pulled over the compressed tobacco leaves and the ends thereof tied together.

Tobacco leaves processed in the above manner have a high sand and dirt content, to which tobacco manufacturers object, since it necessitates the removal of the sand and dirt from the tobacco leaves at the factory and the disposal thereof.

Additionally, the manual packing of the tobacco leaves in the sheeting ring is tedious and time-consuming, and it is often difficult and expensive to obtain labor for performing this operation.

SUMMARY OF THE INVENTION

The present invention comprises an assembly for preparing cured tobacco leaves for sale by first mechanically removing dirt and sand from the leaves, depositing the leaves within a sheeting ring onto a tobacco sheet and then compressing the tobacco leaves with a power actuated compression member, following which the sheeting ring and compressor member is mechanically removed simultaneously, and the ends of the tobacco sheet tied together over the compressed tobacco leaves for removal thereof to a warehouse.

This invention further includes apparatus for compressing the tobacco leaves which may be affixed to a tractor front end loader, the packing operation being carried out on the loader, preparatory to mechanically engaging the compressing member with the sheeting ring to remove the same as a unit from the tobacco, following which the sheeted tobacco may be carried on the front end loader to a warehouse.

The assembly of the present invention affords mobile units for tumbling and packing the tobacco leaves which are moved directly to the curing site for the purpose of cleaning and packing the tobacco leaves, which assembly may be operated by a minimum of persons and which quickly and efficiently performs the cleaning and packing steps.

The present invention, although useful for handling tobacco which has been cured in any manner, is particularly adapted for cleaning and packing tobacco leaves which have been cured in metallic curing containers, which container is placed over a conveyor means, thereby permitting the tobacco to gravitate onto the conveyor where it is transported to the tumbler.

DETAILED DESCRIPTION OF THE INVENTION

Figure 1:
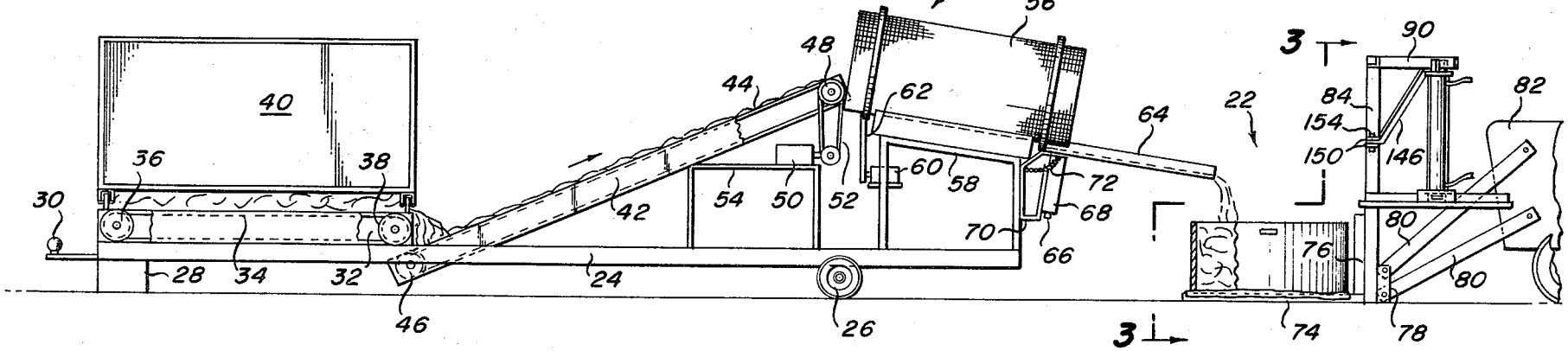
FIG. 1 is a side elevational view of the assembly of the present invention illustrating its use.

In FIG. 1, there is disclosed the assembly of the present invention for cleaning and packing cured tobacco leaves which generally includes a mobile cleaning unit 20 and a mobile packing unit 22.

Mobile cleaning unit 20 comprises an elongated frame 24 suitably supported at one end by wheels 26, the frame being supported at the opposite end by a frame extension 28, adjacent which is a tow bar 30 to permit the cleaning unit to be transported from place to place by attachment to a tractor or the like.

One end of elongated frame 24 is provided with a sub-frame 32 which supports an endless conveyor 34 which extends between drive pulleys 36 and 38. Sub-frame 32 is so constructed that it will receive and hold a standard metal tobacco curing container 40 which permits the tobacco leaves therein to gravitate onto conveyor 34 for carrying the tobacco leaves forwardly of the cleaning unit.

At a point intermediate frame 24, there is provided an upwardly inclined supporting frame 42 on which is mounted an endless conveyor 44 which is driven by drive pulleys 46 and 48 powered by a motor 50 connected to pulley 48 by a drive chain 52. A motor support is indicated at 54.

It will be noted from FIG. 1 that the lower end of conveyor belt 44 is positioned subjacent conveyor belt 34 so that tobacco leaves being conveyed forwardly by endless conveyor 34 are deposited on endless conveyor 44 to carry the tobacco leaves in an upwardly and forwardly direction.

Adjacent the upper end of endless conveyor 44 and supporting frame 42, there is provided a drum 56 made of open wire construction which drum is rotatably mounted on a frame member 58 and is driven in conventional fashion by means of a motor 60 and a drive chain 62 in operative engagement with the drum.

It will be noted from FIG. 1 that drum 56 is disposed at an angle to the horizontal with the upper end thereof proximate endless conveyor 44. In this way, the tobacco leaves are deposited into drum 56 and, as the drum rotates, the leaves will gradually gravitate towards the lower end thereof while at the same time separating sand and dirt therefrom, which sand and dirt drop through the open wire of which the drum is made.

Adjacent the lower end of drum 56, there is provided a chute 64 which is transversely arcuate and receives the leaves from the drum. Chute 64 is swivelly mounted by means of a pin 66 which is movably inserted in a tubular member 68, the latter being affixed to a mounting plate 70. A chain 72 is provided for limiting swivel movement of chute 64.

Mobile packing unit 22 includes a front end loader comprising a horizontal platform 74, and a vertical support 76, the rear face of which is provided with mounting brackets 78 for engagement with support bars 80 carried by a tractor 82.

Extending upwardly from vertical member 76 is a frame including spaced vertical members 84 and 86 connected at the top by a horizontal cross piece 88. In accordance with the present invention, there are provided a pair of movable arms 90 and 92 which are pivotally engaged at 94 and 96 to vertical members 84 and 86. Hydraulic rams 98 and 100 are suspended from the outer end of arms 90 and 92, the lower ends of which rams are affixed to compressing discs 102 and 104.

Figure 5:
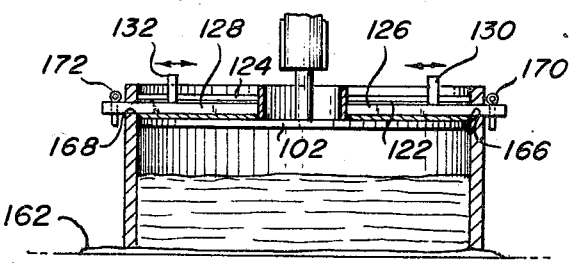
FIG. 5 is a side elevational view of a packer unit, a portion thereof being shown in section, and illustrating the parts thereof in locked engagement.
Figure 2:
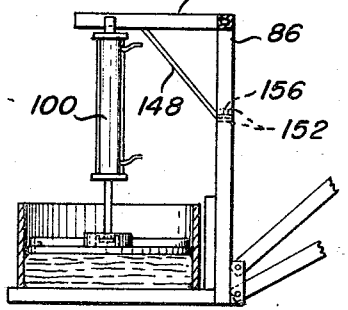
FIG. 2 is a sectional view taken substantially along the lines 2—2 of FIG. 3, showing the same in operative position.
Figure 4:
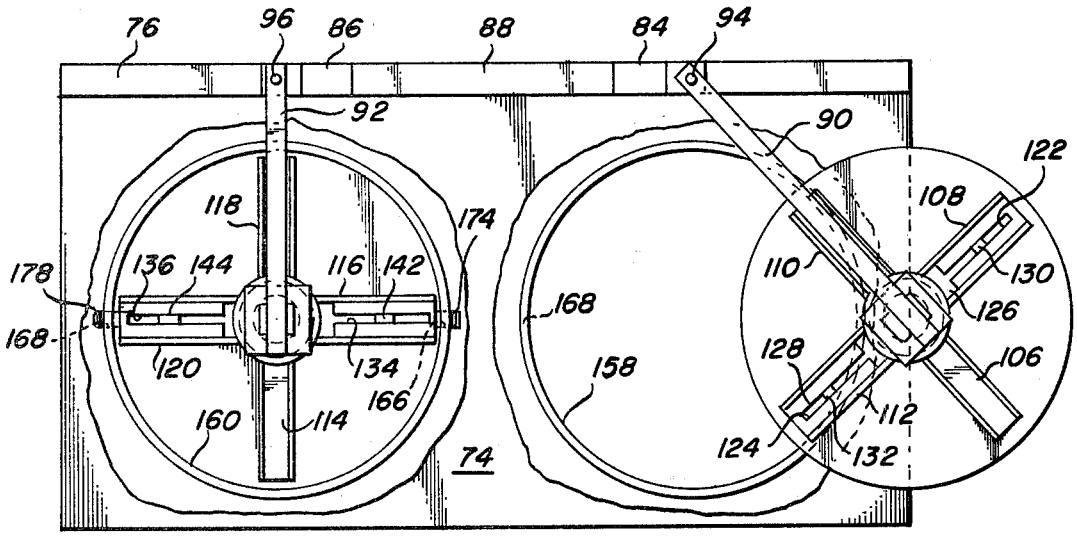
FIG. 4 is a top planned view of the packer assembly.

As shown to advantage in FIGS. 4 and 5, the upper face of discs 102 and 104 are provided with a plurality of channel-shaped reinforcing members, the reinforcing members for disc 102 being being indicated at 106, 108, 110 and 112. The reinforcing channel members of disc 104 are indicated at 114, 116, 118 and 120.

The central portion of each reinforcing members 108 and 112 of disc 102 are spaced from disc 102 and are provided with longitudinal slots designated 122 and 124. Sliding locking members 126 and 128 are positioned between disc 102 and the central portion of reinforcing members 108 and 112. Upstanding actuating members 130 and 132 extend through slots 122 and 124 for sliding the locking members longitudinally of the channel members from a point within the outer periphery of compressing disc 102 to a point beyond the periphery of the disc on opposite sides thereof.

In like manner, the central portion of each of reinforcing members 116 and 120 are provided with longitudinal slots 134 and 136 and locking members 138 and 140 are positioned between disc 104 and reinforcing members 116 and 120. Locking member actuators are indicated at 142 and 144.

Figure 3:
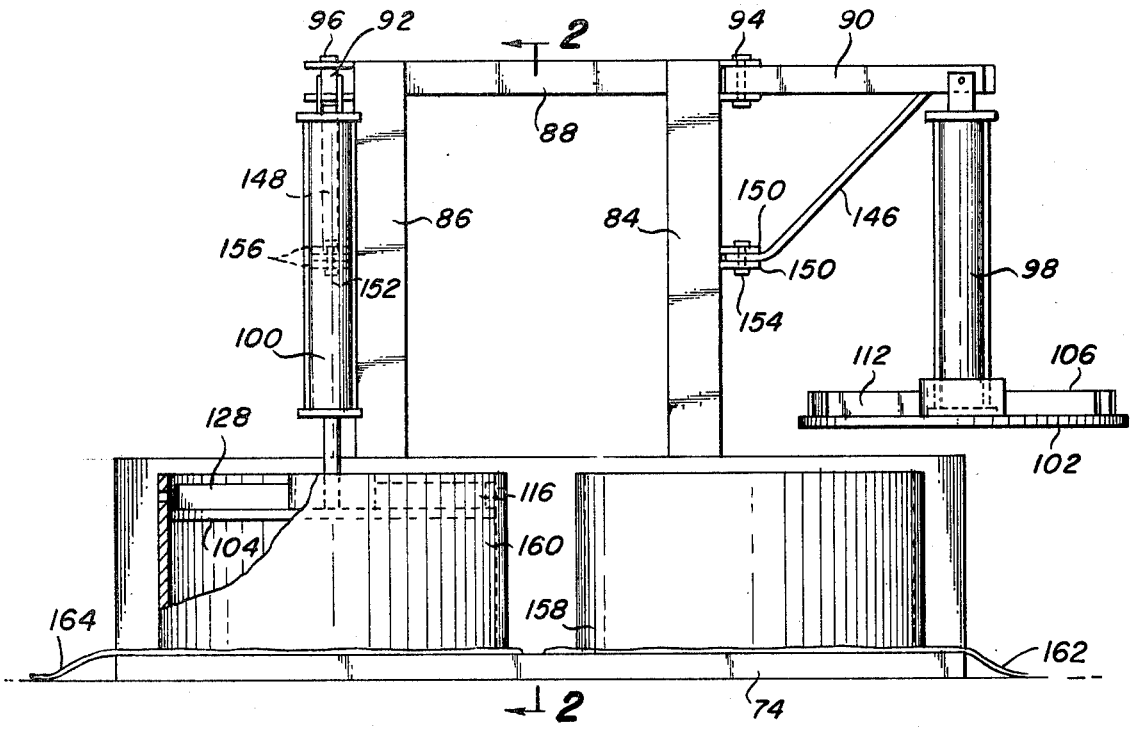
FIG. 3 is an end elevational view taken along the lines 3—3 of FIG. 1, looking in the direction of the arrows.

Brace arms 146 and 148 extend between intermediate parts of movable arms 90 and 92 and vertical members 84 and 86. The upper end of each brace arm is fixedly secured to arms 90 and 92 at a point proximate hydraulic rams 98 and 100, the opposite end thereof being swivelly held between ears 150 and 152 which are mounted on vertical members 84 and 86, respectively, and retained therein by pins 154 and 156. When it is desired to swing the compressing discs to operative position such as shown by disc 104 in FIG. 3, arms 90 and 92 are simply swung to move the arms to a position at right angles to cross piece 88.

In connection with discs 102 and 104, there are provided a pair of tubular sheeting rings designated 158 and 160 which are placed on tobacco sheets 162 and 164, carried by platform 74, Compression discs 102 and 104 are constructed to fit within sheeting rings 158 and 160 so that, when hydraulic rams 98 and 100 are activated, discs 102 and 104 are forced downwardly against the tobacco leaves which have been placed in the sheeting ring.

In order to remove the sheeting ring from the tobacco sheets, each ring is provided with diametrically opposed slots 166 and 168, respectively, which are adapted to receive the terminals of locking members 126 and 128 of disc 102 and locking members 138 and 140 of disc 104. In order to avoid any possibility of accidental disengagement of the locking members from the discs, there are provided locking pins 170 and 172 for disc 102 and 174 and 176 for disc 104. When the locking members of the compressing discs are slid through the slot of the sheet rings, and locking pins put in place, hydraulic ram 100 may be deactivated to raise the compressing discs with the sheeting rings attached thereto as a unit, following which they may be swung to one side out of the way of the packed tobacco leaves to permit removal of the packed tobacco leaves.

OPERATION

In use of the assembly of the present invention, mobile cleaning unit 20 and mobile packing unit 22 are moved to the area in which tobacco is being cured following which the cured tobacco is either manually placed on endless conveyor 34 or, in the case of tobacco which has been cured in curing containers 40, the container itself is placed on frame 24 and the tobacco leaves permitted to gravitate onto the conveyor.

Conveyor 34 transports the tobacco leaves to upwardly and forwardly extending endless conveyor 44, from which point it is deposited into drum 56. The tobacco leaves are tumbled by the drum and, due to the inclination of the drum, pass downwardly and forwardly of the drum, during which time the movement of the tobacco leaves causes dirt, sand and other extraneous materials to separate from the tobacco leaves and fall between the wires of the drum. The clean tobacco leaves are next dropped into chute 66, which chute may be swivelled to direct the tobacco leaves either into sheeting ring 158 or 160, beneath which are tobacco sheets 162 and 164.

When the desired amount of tobacco leaves has been placed within the sheeting rings, compressing discs 102 and 104 may be selectively swung to a point superjacent the sheeting rings, following which hydraulic rams 98 and 100 are actuated to compress the tobacco leaves until the desired compression thereof is effected.

In order to facilitate removal of the sheeting rings from the packed tobacco leaves, locking members 126 and 128 of disc 102 are inserted through slots 166 of disc 102 and locking members 138 and 140 of disc 104 are moved through slots 168 of disc 104. Pins 170 and 172 are engaged with the terminals of locking members 126 and 128 and locking pins 174 and 176 are engaged with the terminals of locking members 138 and 140. Rams 98 and 100 are then actuated in a direction to move the discs and sheeting rings upwardly as a unit, following which they are swung out of the way of the front loader in order to permit access to the packed tobacco leaves for the purpose of tying the ends of tobacco sheets 162 and 164. The packed tobacco may then be transported on the front loader of the tractor to a vehicle for transportation to a warehouse.

With the assembly of the present invention, simple but efficient means are provided for mechanically cleaning tobacco leaves and then packing the same for transportation to a warehouse.

While there has herein been shown and described the presently preferred form of this invention, it is to be understood that such has been done for purposes of illustration only, and that various changes may be made therein within the scope of the appended claims.

What is claimed is:

1. A unit for packing cured tobacco leaves on a tobacco sheet, said unit including:

(a) a forming member having upper and lower limits positioned on the tobacco sheet, the tobacco leaves being placed into the forming member (b) said forming member being provided with diametrically opposed slots proximate the upper limit of the member (c) a compressing member mounted proximate said forming member (d) said compressing member being provided with slidable locking members partially movable through the opposed slots of said forming member for selectively locking the compressing member and forming member together, and (e) power means engaged with said compressing member for urging the latter into packing engagement with the tobacco leaves within said forming member when said compressing member and forming member are disengaged from each other (f) said power means being operative to enable said forming member and compressing member to be lifted as a unit from the packed tobacco leaves when said members are in locking engagement.

2. The packing unit of claim 1, wherein:

(a) said forming member comprises a tubular ring.

3. The packing unit of claim 2, wherein:

(a) said compressing member comprises a disc, the diameter of which is substantially equal to the internal diameter of said ring.

4. The packing unit of claim 1, with the addition of:

(a) a stationary frame positioned adjacent said forming member (b) an arm swingably mounted on said stationary frame (c) said compressing member and power means being mounted on one end of said arm, whereby said compressing member may be swung from the inoperative to the operative position.

5. The packing unit of claim 4, with the addition of:

(a) a brace extending between an intermediate part of said arm and said stationary frame (b) said brace being fixedly engaged with said stationary frame and pivotedly engaged with said arm.

6. The packing unit of claim 5, with the addition of:

(a) a second forming member having upper and lower limits, positioned on the tobacco sheet adjacent the first forming member (b) said second forming member being provided with diametrically opposed slots proximate the upper limit of the member (c) a second compressing member mounted proximate said second forming member (d) said second compressing member being provided with slidable locking members partially movable through the opposed slots of said second forming member for selectively locking said second compressing member and second forming member together, and (e) a second power means engaged with said second compressing member for urging the latter into packing engagement with the tobacco leaves within said second forming member when said second compressing member and second forming member are disengaged from each other (f) said second power means being operative to enable said second forming member and second compressing member to be lifted as a unit from the packed tobacco leaves when said members are in locking engagement.

7. The packing unit of claim 6, with the addition of:

(a) a second arm swingably mounted on said stationary frame (b) said second compressing member and second power means being mounted on one end of said second arm, whereby said compressing member may be swung from the inoperative to the operative position.

8. The packing unit of claim 7, with the adddition of:

(a) a second brace extending between an intermediate part of said second arm and said stationary frame (b) said second brace being fixedly engaged with said stationary frame and pivotally engaged with said second arm.

9. An assembly for cleaning tobacco leaves and packing the cleaned tobacco leaves in a tobacco sheet, said assembly including:

(a) a cleaning unit comprising an elongated frame (b) conveyor means mounted on said frame for directing tobacco leaves placed thereon forwardly of said unit (c) a drum of wire construction rotatably mounted on said frame adjacent one end of said conveyor means for receiving the tobacco leaves therefrom (d) means for rotating said drum to separate sand and dirt from the tobacco leaves, and (e) a packing unit for receiving the cleaned tobacco leaves from said cleaning unit (f) said packing unit including a tubular forming ring having upper and lower limits placed on the tobacco sheet, into which ring the tobacco leaves are placed (g) said tubular forming ring being provided with diametrically opposed slots proximate the upper limit of the ring (h) a compressing disc mounted adjacent said forming ring (i) said compressing disc being provided with slidable locking members partially movable through the opposed slots of said forming ring for selectively locking the compressing disc and forming ring together (j) said packing unit further including power means engaged with said compressing disc for urging the latter into packing engagement with the tobacco leaves within said forming ring when said compessing disc and forming ring are disengaged from each other (k) said power means being operative to enable said forming ring and compressing disc to be lifted as a unit from the packed tobacco when said members are in locking engagement.

* * * * *